US008051747B1

(12) United States Patent
Tsai

(10) Patent No.: US 8,051,747 B1
(45) Date of Patent: Nov. 8, 2011

(54) ONE-WAY RATCHET WRENCH

(76) Inventor: Chiung-Chang Tsai, Taichung (TW)

( * ) Notice: Subject to any disclaimer, the term of this patent is extended or adjusted under 35 U.S.C. 154(b) by 327 days.

(21) Appl. No.: 12/386,811

(22) Filed: Apr. 24, 2009

(51) Int. Cl.
*B25B 13/46* (2006.01)

(52) U.S. Cl. ..... 81/63.2; 81/52

(58) Field of Classification Search ..... 81/63.2, 81/51, 52
See application file for complete search history.

(56) References Cited

U.S. PATENT DOCUMENTS 5,636,557 A * 6/1997 Ma ..... 81/60
6,446,530 B1 * 9/2002 Chang ..... 81/60
6,539,825 B1 * 4/2003 Lin ..... 81/60
6,779,422 B2 * 8/2004 Chen ..... 81/60
6,807,882 B2 * 10/2004 Hu ..... 81/60
2003/0041697 A1 * 3/2003 Hsien ..... 81/60
2004/0163498 A1 * 8/2004 Liu ..... 81/60
2007/0101832 A1 * 5/2007 Lee ..... 81/63.1

* cited by examiner

*Primary Examiner* — Monica Carter
*Assistant Examiner* — Melanie Alexander

(57) ABSTRACT

A one-way ratchet wrench according to the present invention includes a wrench body, a ratchet wheel, a pawl, an anchor, an elastic element and the following elements. A cover is hollow and annular and is annularly provided with a groove. The cover is mounted on the first receiving recess of the wrench body and presses against engaging teeth. A clip ring is mounted between the clip groove of the wrench body and the groove of the cover. The cover and the ratchet wheel are thereby mounted in the first receiving recess of the wrench body such that the cover and the ratchet wheel would not disengage from the first receiving recess of the wrench body during rotation.

3 Claims, 10 Drawing Sheets

B-B

A-A

B-B

ONE-WAY RATCHET WRENCH

BACKGROUND OF THE INVENTION

1. Field of the Invention

The present invention relates to a one-way ratchet wrench having a bevel groove with a specific angle to avoid the disengagement of an elastic element when the wrench is turned.

2. Description of the Prior Art

A conventional structure as disclosed in U.S. Pat. No. 6,807,882 has the shortcomings:

1. The control groove 13 of the wrench body 10 makes a notch in the appearance of the wrench. This results in poor visual aesthetics of the entire assembly.

2. When a drilling tool begins to drill the hole, it is easy to make the position of the drill hole deviated due to the lateral applied force from the arcuate surface. It is more difficult to provide a precise position of the control groove 13. The deviation in the position of the drill hole causes defectives to the wrench body 10.

3. If it is desired to drill a horizontal control groove 13 from the second receiving recess 15, the processing is more inconvenient.

4. It is less easy to assemble the elastic element 70 and the anchor 60 in the narrower second receiving recess 15.

Furthermore, the shortcomings of U.S. Pat. No. 5,979,274 are that the elastic restoring force of the bending elastic element 13 is weakened as well as the life is shorter.

Moreover, the shortcomings of U.S. Pat. No. 5,636,557 are that the structure itself of the control plate 15 is complicated and has more portions to be bending processed so it requires more labor and time in manufacture and it is substantially difficult to meet the manufacture benefit.

SUMMARY OF THE INVENTION

A one-way ratchet wrench according to the present invention includes a wrench body, a ratchet wheel, a pawl, an anchor, an elastic element and the following elements. A cover is hollow and annular and is annularly provided with a groove. The cover is mounted on the first receiving recess of the wrench body and presses against engaging teeth. A clip ring is mounted between the clip groove of the wrench body and the groove of the cover. The cover and the ratchet wheel are thereby mounted in the first receiving recess of the wrench body such that the cover and the ratchet wheel would not disengage from the first receiving recess of the wrench body during rotation.

DETAILED DESCRIPTION OF THE PREFERRED EMBODIMENTS

Figure 1:
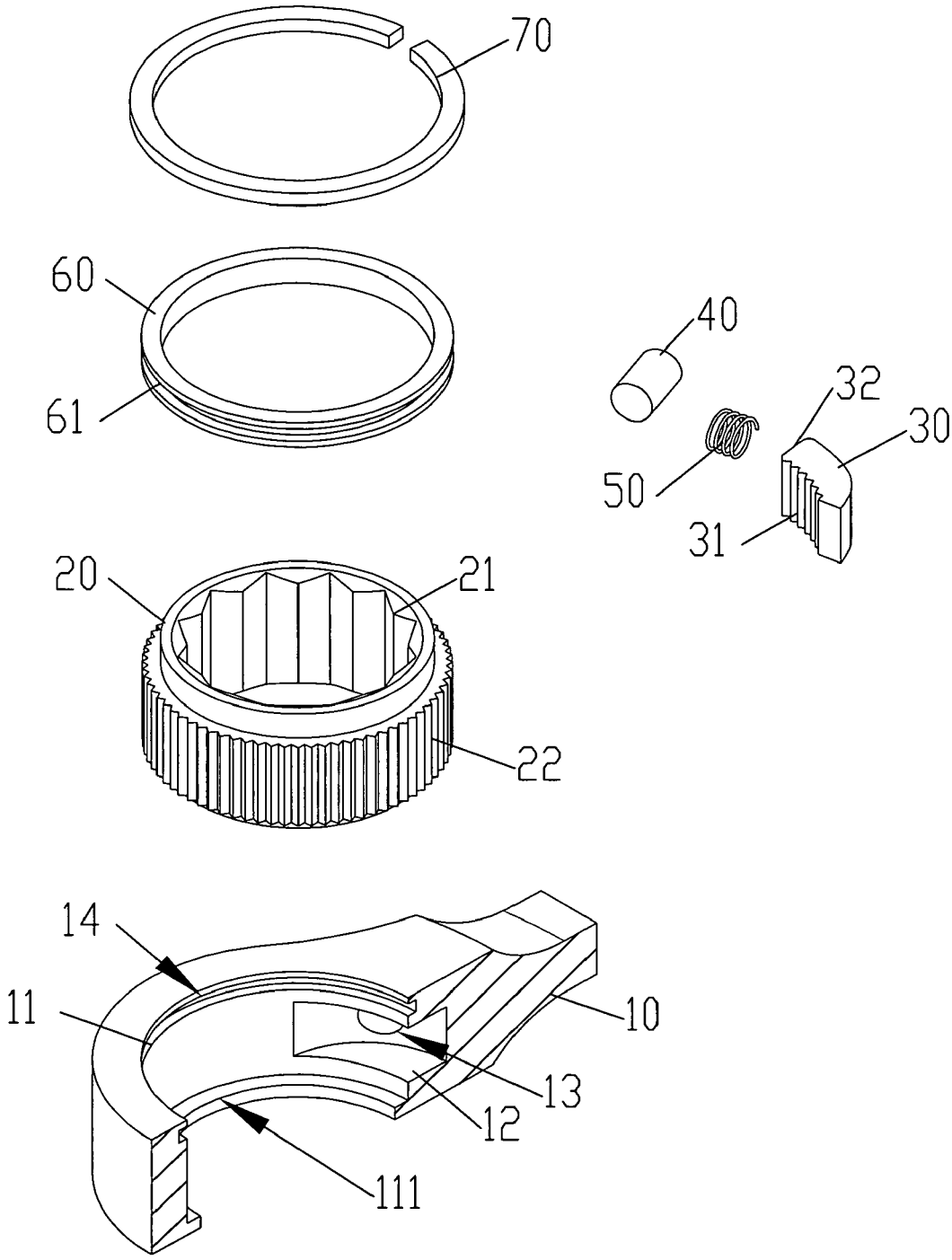
FIG. 1 shows an exploded view.
Figure 2:
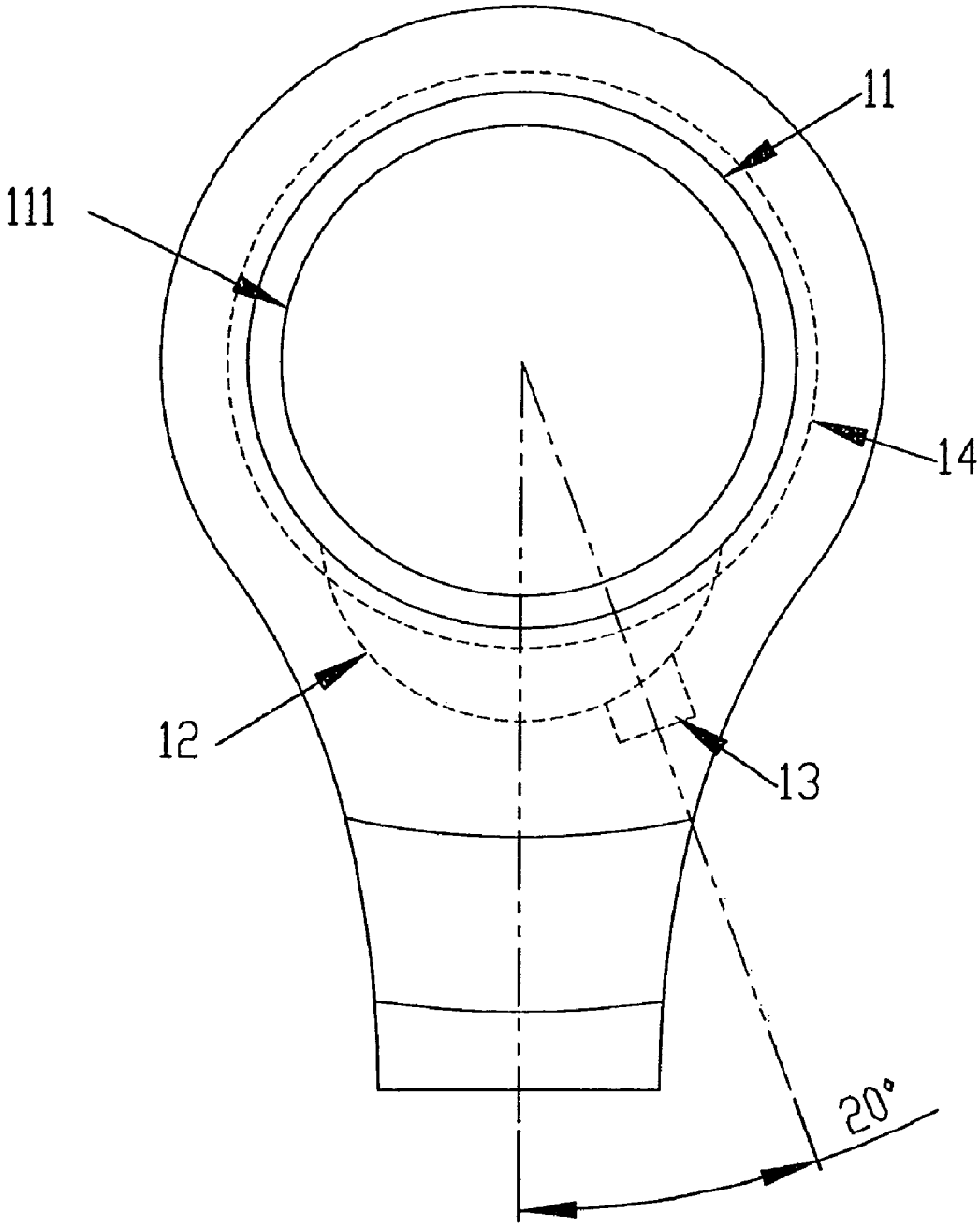
FIG. 2 shows a partial structure.

As illustrated in FIGS. 1 and 2, a one-way ratchet wrench according to the present invention includes a wrench body 10, a ratchet wheel 20, a pawl 30, an anchor 40, an elastic element 50, a cover 60, a clip ring 70 and the following elements:

The acting end of the wrench body 10 is provided with a first receiving recess 11, a smaller-diameter pressing edge 111 is disposed on the bottom surface of the first receiving recess, one side of the first receiving recess is provided with a curved second receiving recess 12 which is communicated with the first receiving recess 11, the diameter of the second receiving recess 12 is smaller than that of the first receiving recess 11, the center of the curve of the second receiving recess 12 is located in the first receiving recess 11, the center of the circle of the first receiving recess 11 is at a distance from that of the second receiving recess 12, the top and bottom of the second receiving recess 12 are closed respectively, a bevel groove is disposed on the periphery on one side of the second receiving recess 12 of the wrench body 10, the bevel groove 13 is circular hole shaped but not through-going, and the longitudinal axis of the bevel groove 13 intersects the center of the circle of the first receiving recess 11 and has an included angle with respect to the axis of the wrench body 10 which is from ten to twenty-five degrees;

The ratchet wheel 20 is pivotally disposed in the first receiving recess 11 and provided with a sleeve portion 21, and engaging teeth 22 are circularly arranged around an outer periphery of the ratchet wheel 20 which presses against the pressing edge 111 of the wrench body 10;

One side of the pawl 30 is provided with pawl teeth 31 for engaging with the engaging teeth 22 of the ratchet wheel 20, one side of the pawl 30 presses against a wall of the second receiving recess 12 of the wrench body 10, and the other side of the pawl 30 is provided with a pressing surface 32;

The anchor 40 is received in the bevel groove 13 of the wrench body 10 and projects into the second receiving recess 12, the anchor 40 does not contact with the engaging teeth 22 of the ratchet wheel 20, and the axis of the anchor 40 intersects the center of the circle of the first receiving recess 11 and has an included angle with respect to the axis of the wrench body 10 which is the same as the included angle between the axis of the bevel groove 13 and the center of the circle of the first receiving recess 11; and One end of the elastic element 50 presses against the pressing surface 32 of the pawl 30, the other end of the elastic element 50 presses against the anchor 40, the elastic force of the elastic element 50 allows the pawl teeth 31 of the pawl 30 to engage with the engaging teeth 22 of the ratchet wheel 20, the anchor 40 is received at a tilt angle in the bevel groove 13, the opening C, defined by the anchor 40 and the pawl 30, becomes smaller in width starting from the inner curved surface of the second receiving recess 12 to the engaging teeth 22 which resides in the first receiving recess 11, and the elastic element 50 is propped between the pawl 30 and the anchor 40 without disengagement such that the elastic element 50 is positioned within the second receiving recess 12.

A cover 60 is hollow and annular and is annularly provided with a groove 61. The cover 60 is mounted on the first receiving recess 11 of the wrench body 10 and presses against engaging teeth 22.

A clip ring 70 is mounted between the clip groove 14 of the wrench body 10 and the groove 61 of the cover 60. The cover 60 and the ratchet wheel 20 are thereby mounted in the first receiving recess 11 of the wrench body 10 such that the cover 60 and the ratchet wheel 20 would not disengage from the first receiving recess 11 of the wrench body 10 during rotation.

Figure 3:
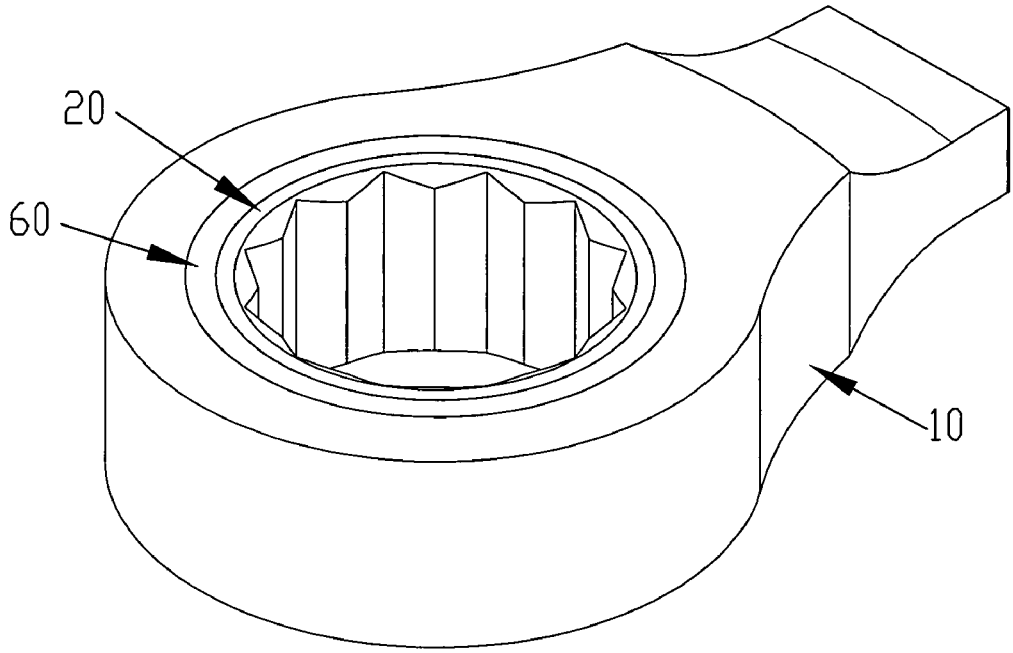
FIG. 3 shows a structure view.
Figure 4:
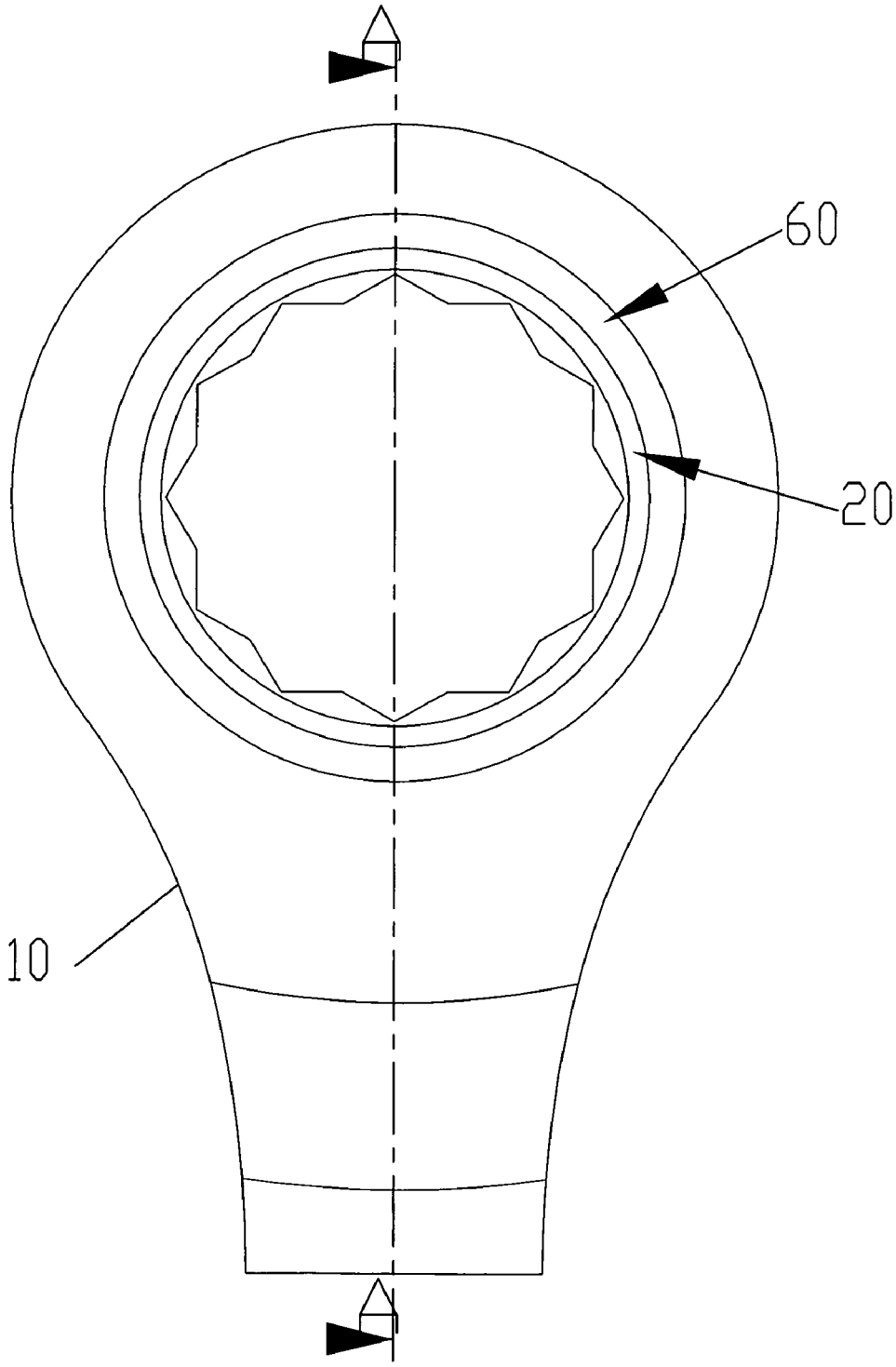
FIG. 4 shows a front elevational view.
Figure 5:
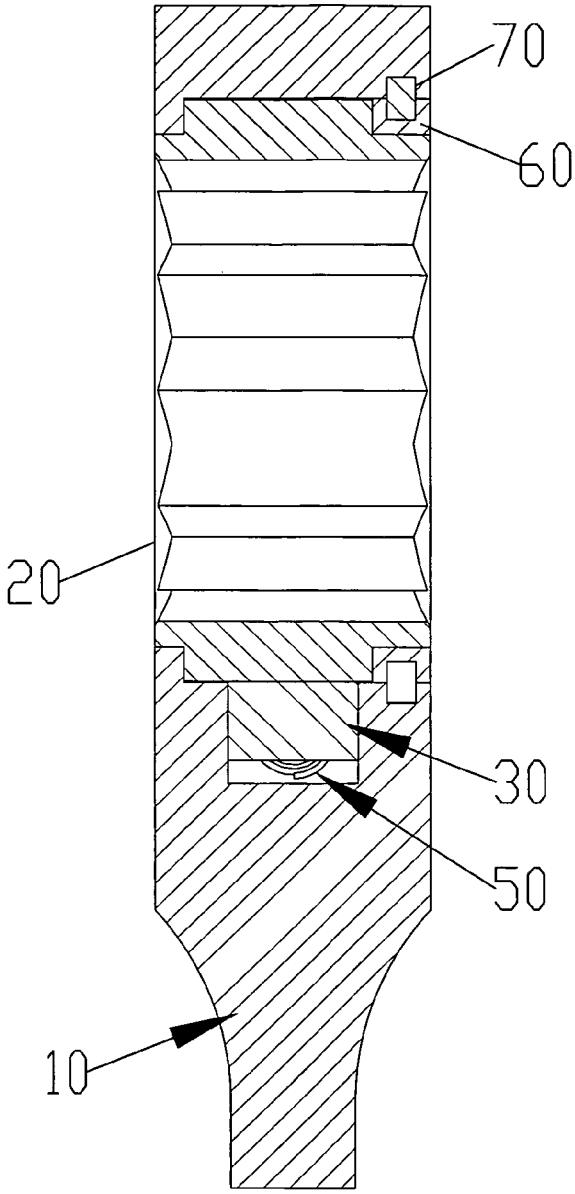
FIG. 5 shows a cross-sectional view of Section A-A of the FIG. 4.

The assembled wrench is shown in FIG. 3. FIG. 4 is a front view of the present invention, and FIG. 5 is a cross-sectional view taken along line A-A of FIG. 4.

Figure 6:
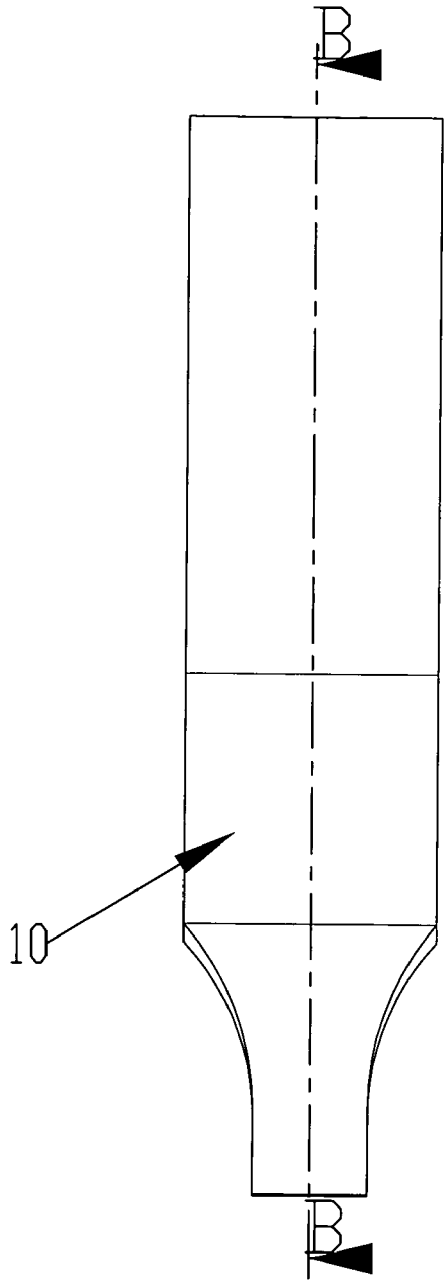
FIG. 6 shows a side elevational view.
Figure 7:
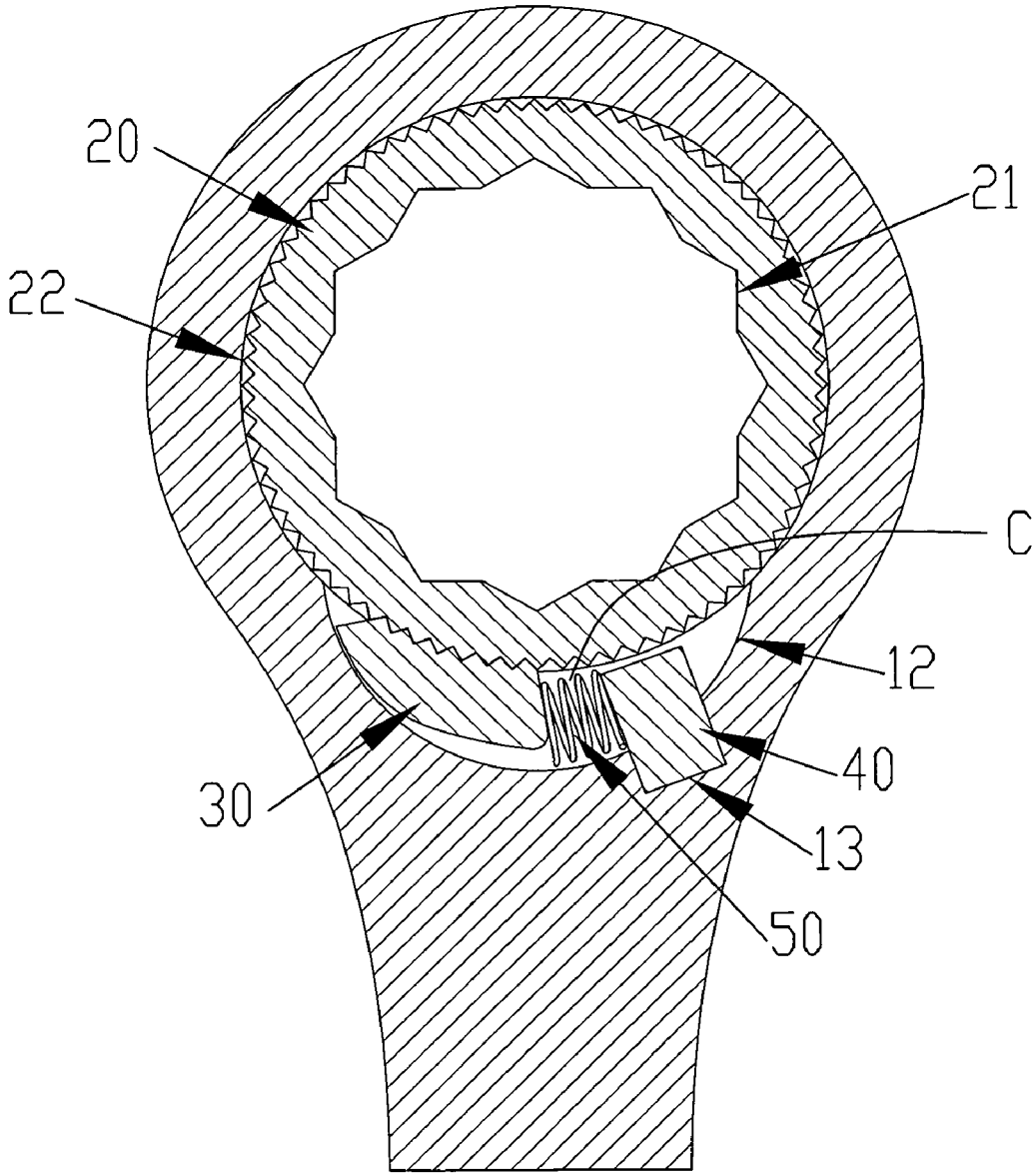
FIG. 7 shows a cross-sectional view of Section B-B of the FIG. 6.

As illustrated in FIGS. 6 and 7, the axis of the bevel groove 13 intersects the center of the circle of the first receiving recess 11 and has an included angle with respect to the axis of the wrench body 10 which is twenty degrees, namely, the center of the circle of the first receiving recess 11 serves as a center point and the bevel groove 13 is disposed on one side deviated from the center point by twenty degrees. The anchor 40 provided within the bevel groove 13 is at a twenty-degree tilt angle. The opening C, defined by the anchor 40 and the pawl 30, becomes smaller in width starting from the inner curved surface of the second receiving recess 12 to the engaging teeth 22 which resides in the first receiving recess 11. The elastic element 50 is propped between the pawl 30 and the anchor 40 without disengagement such that the elastic element 50 is positioned within the second receiving recess 12.

When the wrench body 10 is turned to fasten a workpiece, the engaging teeth 22 of the ratchet wheel 20 engage with the pawl teeth 31 of the pawl 30, one side of the pawl 30 presses against a wall of the second receiving recess 12 of the wrench body 10, and the other side of the pawl 30 presses against the elastic element 50. Thus, the workpiece can be rotated when the ratchet wheel 20 is turned counterclockwise, and free rotation occurs when the ratchet wheel 20 is turned clockwise. The user can change the operation direction as long as the one-way ratchet wrench is turned over to the other side.

Figure 8:
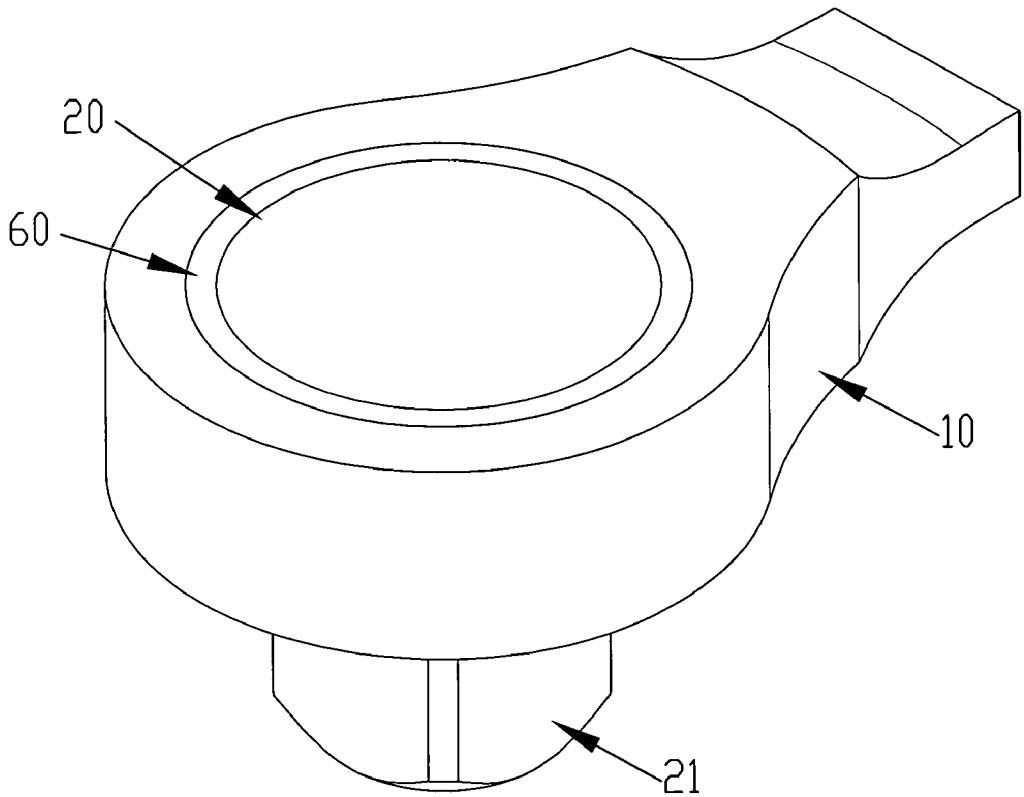
FIG. 8 shows a structure view of a second embodiment.

As illustrated in FIG. 8, a sleeve portion 21 of the ratchet wheel 20 may be in the form of a rectangular head for mating with a sleeve.

Figure 9:
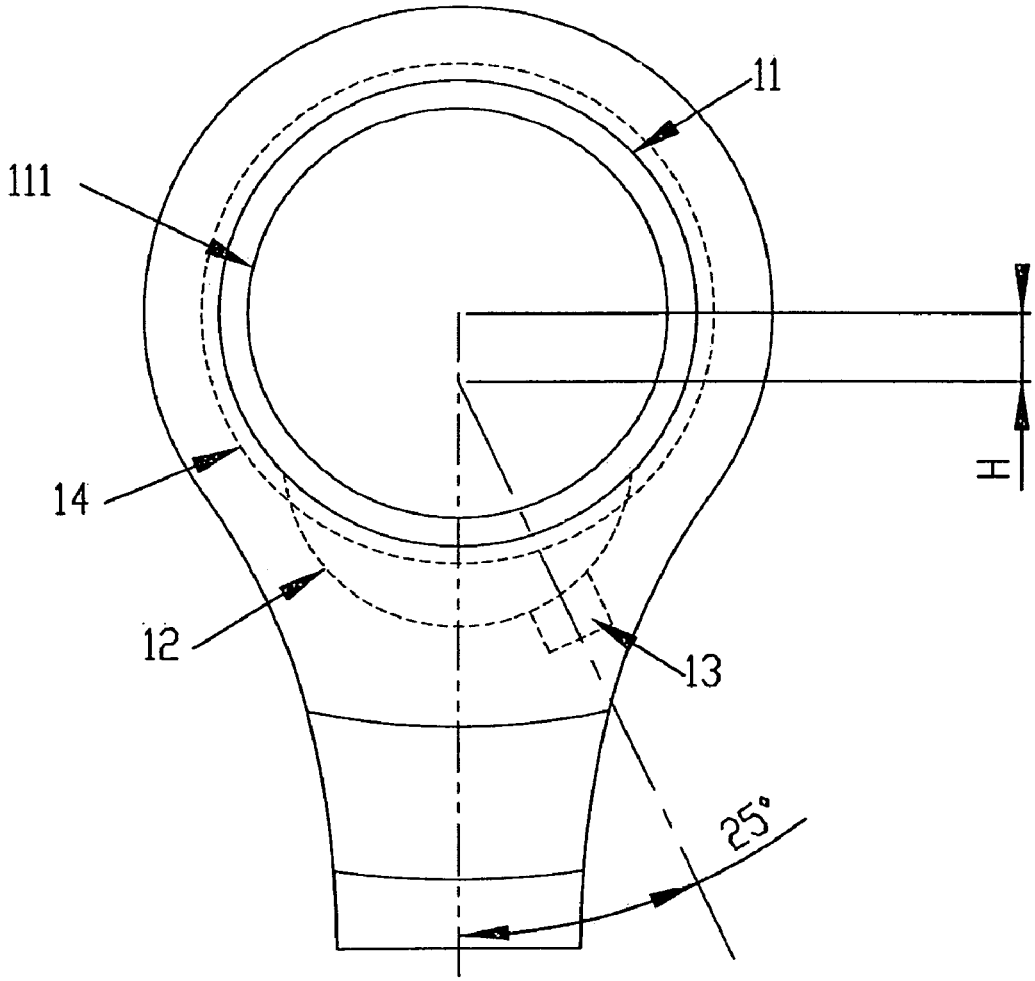
FIG. 9 shows a structure view of a third embodiment.

As illustrated in FIG. 9, the bevel groove 13 is disposed on the periphery on one side of the second receiving recess 12 of the wrench body 10. The position where the axis of the bevel groove 13 of the wrench body 10 intersects the axis of the wrench body 10 is located between the centers of the circles of the first receiving recess 11 and the second receiving recess 12, and has a specific spacing H with respect to the center of the circle of the first receiving recess 11. The axis of the bevel groove 13 and the axis of the wrench body 10 have an included angle of twenty-five degrees, or the position where the axis of the bevel groove 13 of the wrench body 10 intersects the axis of the wrench body 10 coincides with the center of the circle of the second receiving recess 12. In the above both cases, there is a small opening C such that the elastic element 50 is positioned within the second receiving recess 12.

Figure 10:
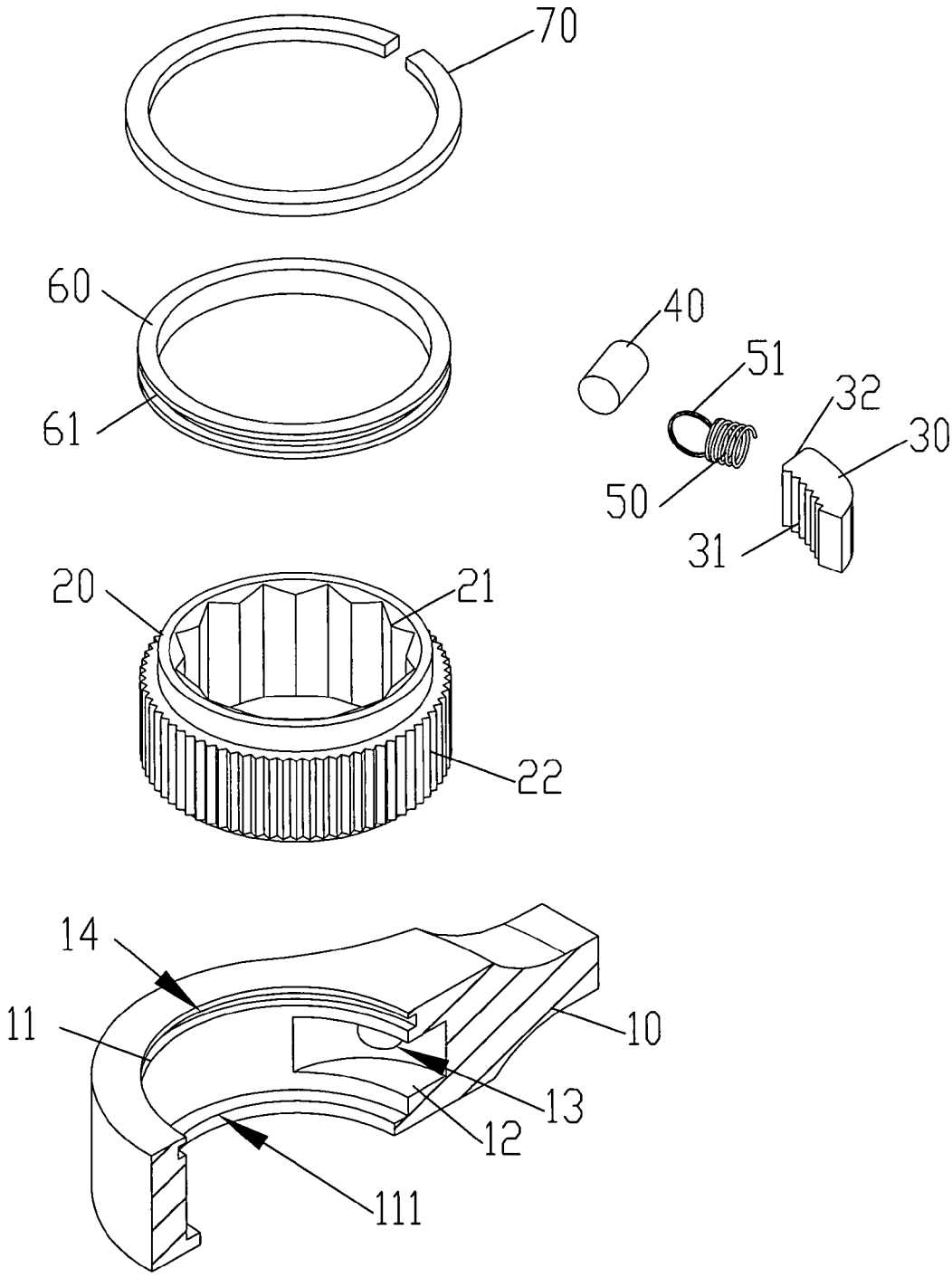
FIG. 10 shows a exploded view of a fourth embodiment.

As illustrated in FIG. 10, the elastic element 50 is provided with a portion 51 sleeved on the anchor 40 for better positioning of the elastic element 50.

The present invention has the advantages as below:

1. The closer to the first receiving recess 11 the opening C defined by the anchor 40 and the pawl 30 goes, the smaller the opening C is. The elastic element 50 is propped between the pawl 30 and the anchor 40 without disengagement such that the elastic element 50 is positioned within the second receiving recess 12 of the wrench body 10.

2. The appearance of the wrench remains intact, thereby providing improved visual aesthetics.

3. As illustrated in FIGS. 2 and 7, that the bevel groove 13 is slightly deviated from the original position, or the included angle is eighteen, nineteen or twenty-two degrees.

4. The assembly of the wrench is made in an easy and convenient way and in less time.

What is claimed is:

1. A one-way ratchet wrench comprising a wrench body, a ratchet wheel, a pawl, an anchor, an elastic element, a cover and a clip ring, wherein:

the acting end of the wrench body is provided with a circular first receiving recess, a smaller-diameter pressing edge is disposed on the bottom surface of the first receiving recess, one side of the first receiving recess is provided with a curved second receiving recess which is communicated with the first receiving recess, the diameter of the second receiving recess is smaller than that of the first receiving recess, the center of the curve of the second receiving recess is located in the first receiving recess, the center of the circle of the first receiving recess is at a distance from that of the second receiving recess, the top and bottom of the second receiving recess are closed respectively, a bevel groove is disposed on the periphery on one side of the second receiving recess of the wrench body, the bevel groove is circular hole shaped but not through-going, and the longitudinal axis of the bevel groove intersects the center of the circle of the first receiving recess and has an included angle with respect to the axis of the wrench body which is from ten to twenty-five degrees;

the ratchet wheel is pivotally disposed in the first receiving recess and provided with a sleeve portion, and engaging teeth are circularly arranged around an outer periphery of the ratchet wheel which presses against the pressing edge of the wrench body;

one side of the pawl is provided with pawl teeth for engaging with the engaging teeth of the ratchet wheel, one side of the pawl presses against a wall of the second receiving recess of the wrench body, and the other side of the pawl is provided with a pressing surface;

the anchor is received in the bevel groove of the wrench body and projects into the second receiving recess, the anchor does not contact with the engaging teeth of the ratchet wheel, and the axis of the anchor intersects the center of the circle of the first receiving recess and has an included angle with respect to the axis of the wrench body which is the same as the included angle between the axis of the bevel groove and the center of the circle of the first receiving recess;

one end of the elastic element presses against the pressing surface of the pawl, the other end of the elastic element presses against the anchor, the elastic force of the elastic element allows the pawl teeth of the pawl to engage with the engaging teeth of the ratchet wheel, the anchor is received at a tilt angle in the bevel groove, the closer to the first receiving recess the opening defined by the anchor and the pawl goes, the smaller the opening is, and the elastic element is propped between the pawl and the anchor without disengagement such that the elastic element is positioned within the second receiving recess;

the cover is hollow and annular and is annularly provided with a groove, the cover is mounted on the first receiving recess of the wrench body and presses against engaging teeth; and the clip ring is mounted between a clip groove of the wrench body and the groove of the cover, the cover and the ratchet wheel are thereby mounted in the first receiving recess of the wrench body such that the cover and the ratchet wheel would not disengage from the first receiving recess of the wrench body during rotation.

2. The one-way ratchet wrench of claim 1, wherein said elastic element is provided with a portion sleeved on the anchor.

3. A one-way ratchet wrench comprising a wrench body, a ratchet wheel, a pawl, an anchor and an elastic element, wherein:

the acting end of the wrench body is provided with a circular first receiving recess, a smaller-diameter pressing edge is disposed on the bottom surface of the first receiving recess, one side of the first receiving recess is provided with a curved second receiving recess which is communicated with the first receiving recess, the diameter of the second receiving recess is smaller than that of the first receiving recess, the center of the curve of the second receiving recess is located in the first receiving recess, the center of the circle of the first receiving recess is at a distance from that of the second receiving recess, the top and bottom of the second receiving recess are closed respectively, a bevel groove is disposed on the periphery on one side of the second receiving recess of the wrench body, the bevel groove is circular hole shaped but not through-going, and the longitudinal axis of the bevel groove intersects the center of the circle of the first receiving recess and has an included angle with respect to the axis of the wrench body which is from twenty to thirty degrees;

the ratchet wheel is pivotally disposed in the first receiving recess and provided with a sleeve portion, and engaging teeth are circularly arranged around an outer periphery of the ratchet wheel which presses against the pressing edge of the wrench body;

one side of the pawl is provided with pawl teeth for engaging with the engaging teeth of the ratchet wheel, one side of the pawl presses against a wall of the second receiving recess of the wrench body, and the other side of the pawl is provided with a pressing surface;

the anchor is received in the bevel groove of the wrench body and projects into the second receiving recess, the anchor does not contact with the engaging teeth of the ratchet wheel, and the axis of the anchor intersects the center of the circle of the first receiving recess and has an included angle with respect to the axis of the wrench body which is the same as the included angle between the axis of the bevel groove and the center of the circle of the first receiving recess;

one end of the elastic element presses against the pressing surface of the pawl, the other end of the elastic element presses against the anchor, the elastic force of the elastic element allows the pawl teeth of the pawl to engage with the engaging teeth of the ratchet wheel, the anchor is received at a tilt angle in the bevel groove, the closer to the first receiving recess the opening defined by the anchor and the pawl goes, the smaller the opening is, and the elastic element is propped between the pawl and the anchor without disengagement such that the elastic element is positioned within the second receiving recess.

* * * * *